US008006752B2

(12) United States Patent
Basler

(10) Patent No.: US 8,006,752 B2
(45) Date of Patent: Aug. 30, 2011

(54) GUIDE TUBE FOR CONTINUOUS ROD

(75) Inventor: Hermann Basler, Alberta (CA)

(73) Assignee: Weatherford/Lamb, Inc., Houston, TX (US)

( * ) Notice: Subject to any disclaimer, the term of this patent is extended or adjusted under 35 U.S.C. 154(b) by 411 days.

(21) Appl. No.: 12/352,464

(22) Filed: Jan. 12, 2009

(65) Prior Publication Data

US 2010/0175892 A1 Jul. 15, 2010

(51) Int. Cl.
*E21B 19/22* (2006.01)

(52) U.S. Cl. ..... 166/77.2; 166/75.11; 166/77.1

(58) Field of Classification Search ..... 166/77.2, 166/85.1, 85.5, 75.11, 378, 77.1
See application file for complete search history.

(56) References Cited

U.S. PATENT DOCUMENTS

| | | | | |
|---|---|---|---|---|
| 970,773 | A | 9/1910 | Wylie et al. | |
| 3,631,537 | A | 12/1971 | Zibolski et al. | |
| 5,292,016 | A | 3/1994 | Casavant et al. | |
| 6,880,630 | B2 * | 4/2005 | Widney | 166/77.53 |
| 2003/0159821 | A1 * | 8/2003 | Andersen et al. | 166/77.1 |

OTHER PUBLICATIONS

"COROD(r) Specification Chart;" Weatherford Artificial Lift Systems; weatherford.com.
"Weatherford Sucker Rods: Choices in Technology for Your Sucker-Rod Needs;" Informational Brochure; (c) 2003-2007 Weatherford.
COROD(r): Continuous Sucker Rod; Informational Brochure; (c) 1999-2008 Weatherford.

* cited by examiner

*Primary Examiner* — Giovanna C Wright
*Assistant Examiner* — Brad Harcourt
(74) *Attorney, Agent, or Firm* — Wong, Cabello, Lutsch, Rutherford & Brucculeri, LLP

(57) ABSTRACT

A guide tube for continuous rod has a sections pivotably connected together by at least one translatable pivot. The tube connects to a rig at a fixed pivot and is initially folded on the rig for transport. To unfold and raise the tube for operation, a rig operator pivots a support rod pivotably connected to the tube away from the rig using a rope. This pivoting support rod moves the attachment point of a winchline extending from the rig to the rod beyond the tube's fixed pivot. Also, the pivoting rod tensions a sling having a fixed length that extends from the rod to the tube's translatable pivot. In this way, the winchline can be tensioned without the need for rig operators to perform a substantial amount of manual labor as conventionally done. Once the outer sections of the guide tube are lowered to the ground, the entire guide tube can be unfolded and raised with the tensioned winchline.

28 Claims, 3 Drawing Sheets

GUIDE TUBE FOR CONTINUOUS ROD

BACKGROUND

Operators use continuous rod for artificial lift systems, pump applications, and various other well operations. The continuous rod, such the COROD® brand of continuous rod, only requires couplings at the top and bottom of the rod string, unlike conventional sucker rods that are coupled together every 25 or 30 ft. To install the continuous rod, operators use a rig commonly referred to as a "CORIG." As shown in FIG. 1, for example, the rig 10 can be a mobile truck having a mast 14 that can be raised and lowered. When the mast 14 is raised, operators unfold a guide tube 20 from the mast 14 using manual labor and a winchline 50 connected to a winch 12. Once unfolded, the guide tube 20 can guide lengths of continuous rod from a reel (not shown) on which the rod is wound, and a hydraulically driven gripper mechanism 16 on the rig 10 feeds the continuous rod into a wellbore or the like.

Currently, operators must perform a great deal of manual labor to set up the guide tube 20 on the rig 10. As shown in FIG. 2A, for example, the guide tube 20 is initially folded against the rig's mast 14 when transported. To begin unfolding the guide tube 20, operators first connect the winchline 50 to distal sections 22-3 and 22-4 of the guide tube 20 and lower them to the ground, as shown in FIG. 2B. Once the sections 22-3/22-4 have been lowered, operators then push these sections 22-3/22-4 manually away from the rig's mast 14 and attach the winchline 50 to a pivot point 40, as shown in FIG. 2B. Eventually, as shown in FIG. 2C, operators have pushed the pivot 40 far enough beyond the fixed pivot 30 so the winchline 50 can work effectively. Finally, operators use the winchline 50 to raise the guide tube 20 as shown in FIGS. 3A-3C until the guide tube 20 completes its round shape for guiding continuous rod.

In the past, the manual labor involved in unfolding and raising the guide tube for such a rig has simply been accepted in the industry. This has required experienced operators to pay particular attention to safety issues, work site conditions, and other considerations. As always, operators continually seek to improve their operations. For this reason, a way to unfold and raise a guide tube that requires less manual labor is needed.

SUMMARY

A device and technique disclosed herein can unfold and raise a guide tube for continuous rod without requiring substantial manual labor by rig operators. The guide tube has a plurality of guide tube sections pivotably connected together by at least one translatable pivot. The guide tube mounts on the mast of a rig at a fixed pivot and is initially folded on the rig's mast for storage and transport. To unfold and raise the guide tube for operation, a rig operator attaches a winchline from the rig to distal guide tube sections and uses the winchline to lower these sections to the ground.

The operator then connects the winchline to a support rod disposed on the guide tube between the fixed pivot and a translatable pivot. Preferably, this support rod pivotably connects to a guide tube section so the rod can be folded away for storage and transport. The rig operator can pivot the support rod away from the rig using a rope. By pivoting the support rod, the attachment point between the winchline and the support rod is moved beyond the tube's fixed pivot so that the winchline can be properly tensioned. Also, pivoting the support rod tensions a sling having a fixed length that extends from the support rod to the tube's translatable pivot. In this way, the winchline can be tensioned without the need for the rig operators to perform the manual labor conventionally required. Finally, the entire guide tube can be unfolded and raised with the tensioned winchline in one move.

DETAILED DESCRIPTION

Figure 1:
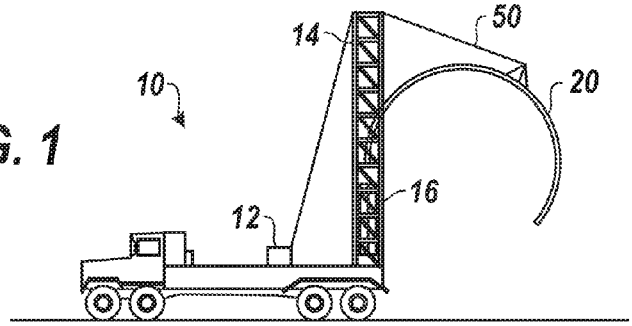
FIG. 1 illustrates a rig for continuous rod according to the prior art.
Figure 2A:
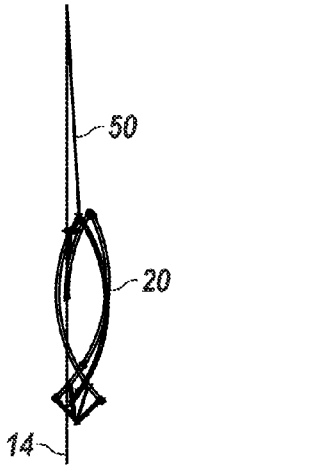
FIG. 2A (Prior Art)
FIGS. 2A-2C show the conventional technique of the prior art for unfolding a guide tube.
Figure 2B:
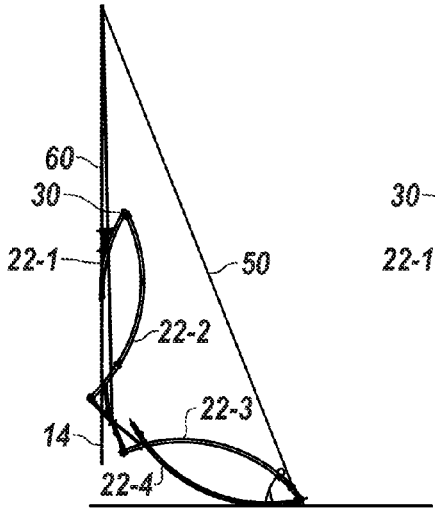
FIG. 2B (Prior Art)
Figure 2C:
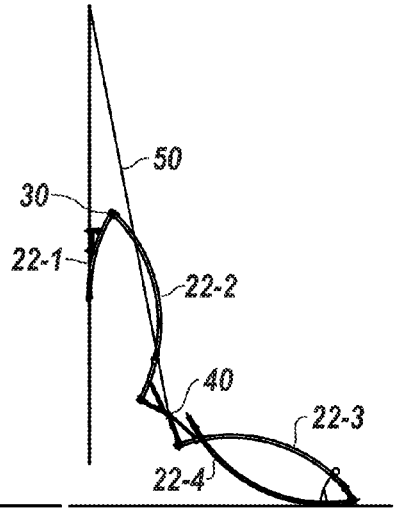
FIG. 2C (Prior Art)
Figure 3A:
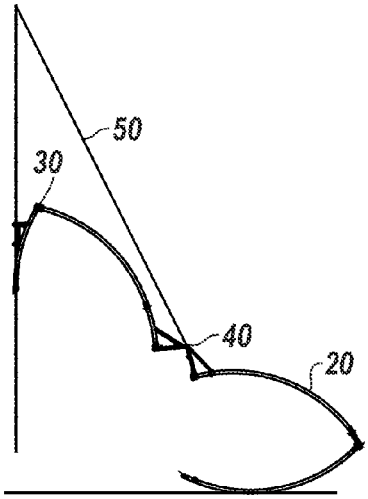
FIG. 3A (Prior Art)
FIGS. 3A-3C show the convention technique for raising the guide tube.
Figure 3B:
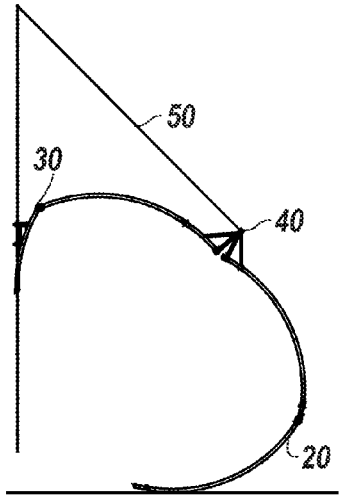
FIG. 3B (Prior Art)
Figure 3C:
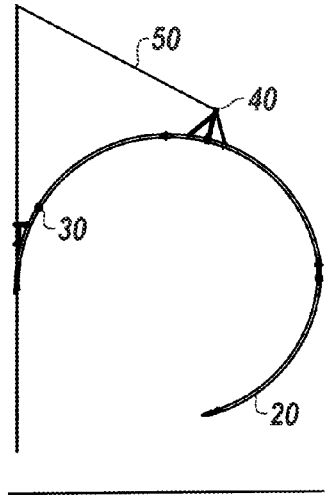
FIG. 3C (Prior Art)

A guide tube 20 shown in FIGS. 4A-4D has a plurality of guide tube sections 22 pivotably connected together and mounted on a rig's mast 14. The sections 22 include a first section 22-1 mounted on the mast 14, a second section 22-2 pivotably connected to the first section 22-1 at a fixed pivot 30, a third section 22-3 pivotably connected to the second section 22-2 at a translatable pivot 40, and a fourth section 22-4 pivotably connected to the third section 22-3. Although the guide tube 20 as discussed above has four sections 22, the guide tube 20 can have any numbers of sections and pivots.

In general, the fixed pivot 30 remains stationary with respect to the rig's mast 14. However, the fixed pivot 30 as well as the guide tube 20 may be able to be turned or rotated relative to the mast 14 so that the entire guide tube 20 can be oriented at a desired angle. The other pivots between the guide tube sections 22 including pivot 40 can be translated relative to the rig's mast 14 as the guide tube 20 is unfolded, raised, lowered, and folded. When ultimately unfolded and raised to its final position (See FIG. 5C), the guide tube 20 forms a circular path for guiding continuous rod between the rig's mast 14 and a reel (not shown) on which the continuous rod is wound.

Figures 4A, 4B, 4C, 4D:
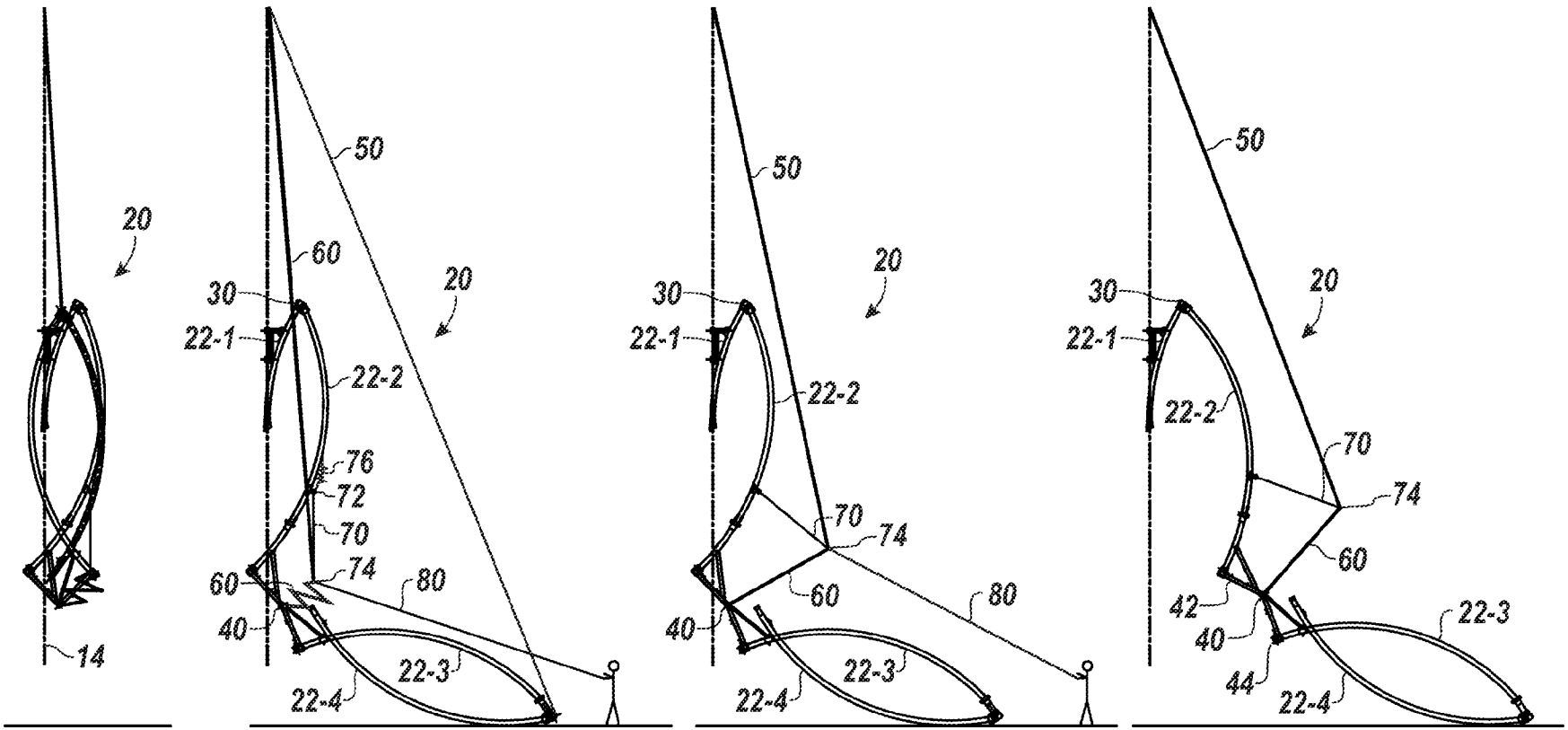
FIGS. 4A-4D show a technique for unfolding a guide tube according to the present disclosure.

As initially shown in FIG. 4A, the guide tube 20 is folded against the rig's mast 14 for storage and transport. To begin unfolding the guide tube 20, a rig operator connects the winchline 50 to the pivot between guide tube sections 22-3/22-4 and lowers these sections 22-3/22-4 to the ground, as shown in FIG. 4B. Then, the rig operator disconnects the winchline 50 from the guide tube 20 and attaches it to a support rod 70 disposed on the second section 22-2. This support rod 70 preferably has a pivotable connection 72 to the guide tube 20 so the support rod 70 can be pivoted toward the rig's mast 14 and kept out of the way for storage and transport.

As shown in FIGS. 4B-4C, the rig operator uses a rope 80 to pivot the support rod 70 away from the mast 14 so that the attachment point 74 of the winchline 50 to the support rod 70 moves past the vertical position of the fixed pivot 30 on the mast 14. Pulling the support rod 70 also extends a sling 60 or other collapsible connection (shown loose in FIG. 4B as a zigzag line) that extends from the support rod 70 to the translatable pivot 40. In this way, the attachment provided by the support rod 70 and the sling 60 between the winchline 50 and the guide tube 20 is moved outward from the fixed pivot 30 so that the winchline 50 can be used effectively to lift the guide tube 20.

At this point, operators tension the winchline 50 and sling 60, as shown in FIG. 4D, and begin lifting the guide tube 20. To facilitate closing of the sections 22 together to form the final shape, the guide tube 20 preferably has a linkage at the translatable pivot 40. As best shown in FIG. 4D, for example, this linkage has first and second links 42/44 pivotably connected together. In turn, the first link 42 pivotably connects to the second section 22-2, and the second link 44 pivotably connects to the third section 22-3.

Figure 5C:
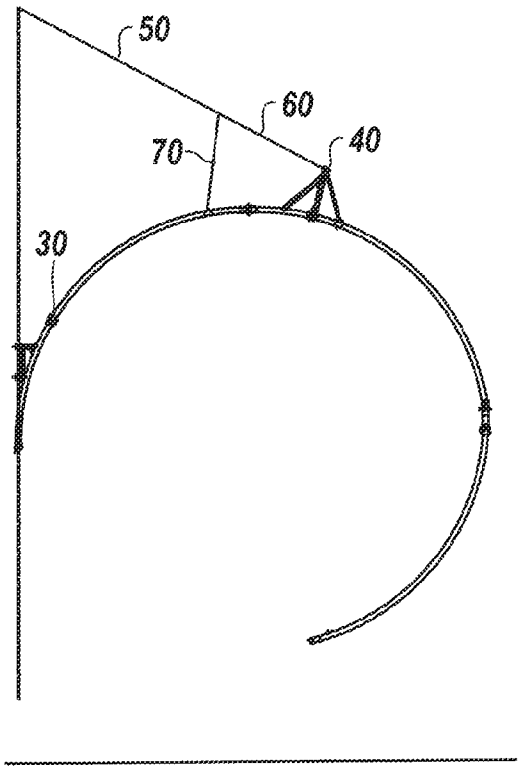
FIGS. 5A-5C show a technique for raising a guide tube according to the present disclosure.
Figure 5B:
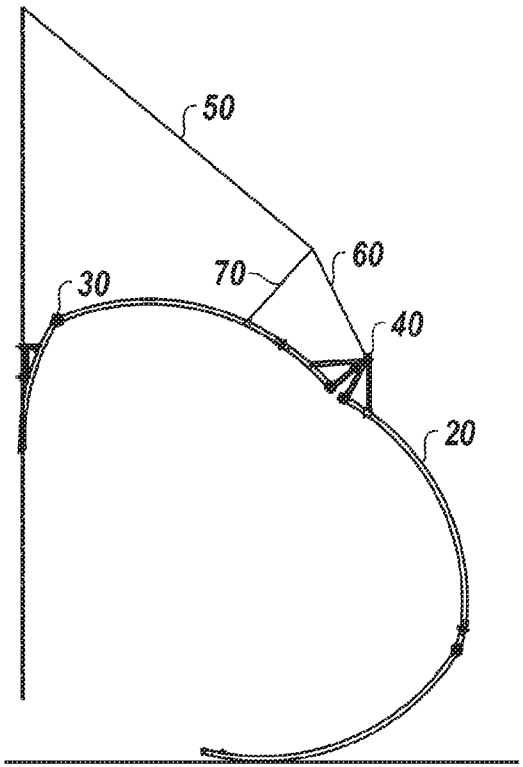
Figure 5A:
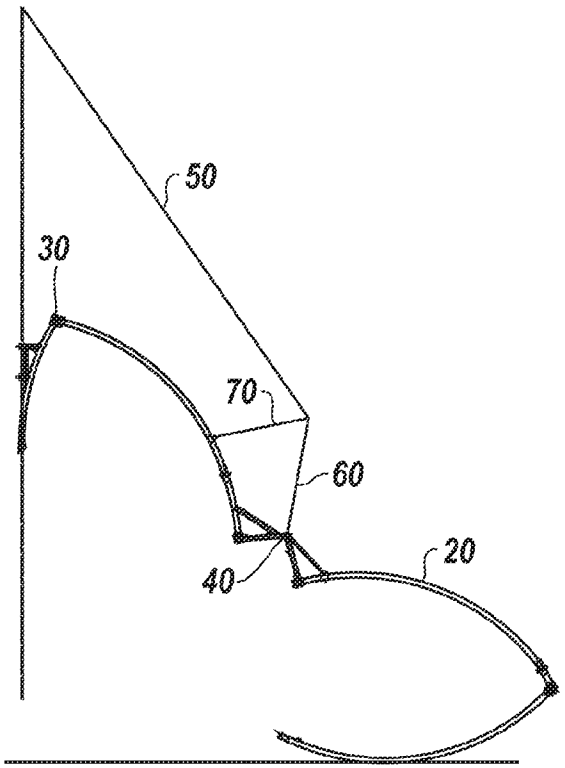

Ultimately, as shown in FIGS. 5A-5C, operators lift the guide tube 20 with the winchline 50 so that the sections 22 close into their final position for guiding continuous rod, as shown in FIGS. 5C. In this lifting, the support provided by the rod 70 and the fixed length sling 60 still allow the guide tube sections 22 to be properly lifted so they can pivot relative to one another and form the rounded shape for guiding continuous rod.

As can be seen in the above technique, a rig operator only needs to perform minimal manual labor to pull the support rod 70 with the rope 80 into the proper position so the winchline 50 can be tensioned to unfold and raise the guide tube. This reduces the time and hazard involved in setting up the guide tube 20 for operation. In addition to unfolding and raising the guide tube 20, the reverse procedure can be performed to lower and fold the guide tube 20 on the rig's mast 14 for storage and transport. This reverse procedure involves the opposite operations of loosening the winchline 50 to lower the guide tube 20, lifting the lower sections 22-3/22-4 with the winchline 50, and pivoting the support rod 70 toward the rig's mast 14 for storage.

The foregoing description of preferred and other embodiments is not intended to limit or restrict the scope or applicability of the inventive concepts conceived of by the Applicants. With the benefit of the present disclosure, other alternatives are possible. For example, the support rod 70 has been discussed above in FIGS. 4A-4D as being pivotably connected to the guide tube 20 by the pivotable connection 72 so the rod 70 can be moved away for storage and transport. As an alternative, the support rod 70 may have a fixed connection to the guide tube 20 in which case at least some of the manual operations discussed above would not be needed. In another alternative, the support rod 70 may still have the pivotable connection 72 to the guide tube 20 as described, but a tensioned spring or remotely controlled device (76; FIG. 4B) may be used to bias or pivot the rod 70 away from the rig's mast 14 instead of being pivoted by an operator with a rope 80.

Although the intermediate support provided by the sling 60 has been described in FIGS. 4A-4D as a line extending from the support rod 70 to the translatable pivot 40, the sling 60 can be any suitable collapsible connection, such as a jointed rod, spring, wire, cable, chain, etc. In addition, the sling 60, although described as being a separate line from the winchline 50, can actually be a fixed length piece of the winchline 50 attached between the rod 70 and pivot 40. For example, the winchline 50 can extend from the rig's mast 14 to the distal end of the support rod 70 from which a fixed length piece of the winchline 50 constituting the collapsible sling 60 can extend and attach to the translatable pivot 40. In another alternative, a support bar rather than the sling 60 may be used for the intermediate support. This support bar 60 can be part of or attach to the support rod 70 and can extend to the pivot 40. As such, this support bar 60 may or may not be collapsible, and the support bar 60 can be pre-attached to the rod 70 or could be added by a rig operator during set up.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A continuous rod guide tube, comprising:

a plurality of guide tube sections for guiding continuous rod from a reel to a rig, the guide tube sections pivotably connected together by at least one translatable pivot and mounted on the rig at a fixed pivot;

a support rod for lifting and unfolding the guide tube sections, the support rod disposed on one of the guide tube sections between the at least one translatable pivot and the fixed pivot, the support rod connectable to a winchline extendable from the rig to the support rod; and an intermediate support having a fixed length and extendable from the support rod to the at least one translatable pivot.

2. The guide tube of claim 1, wherein the intermediate support comprises a collapsible connection between the support rod and the at least one translatable pivot.

3. The guide tube of claim 2, wherein the collapsible connection comprises a fixed length piece of the winchline attaching between the support rod and the at least one translatable pivot.

4. The guide tube of claim 2, wherein the collapsible connection comprises a sling separate from the winchline, the sling having one end attaching to the support rod and having another end attaching to the at least one translatable pivot.

5. The guide tube of claim 1, wherein the intermediate support comprises a support bar connectable between the support rod and the at least one translatable pivot.

6. The guide tube of claim 1, wherein the support rod pivotably connects to the one guide tube section.

7. The guide tube of claim 1, wherein the at least one translatable pivot comprises a linkage having first and second links pivotably connected together at a pivot point to which the intermediate support connects, the first link pivotably connected to one of the adjacent guide tube sections, the second link pivotably connected to the other adjacent guide tube section.

8. The guide tube of claim 1, wherein the guide tube sections comprise:

a first guide tube section mounted on the rig and having the fixed pivot;

a second guide tube section pivotably connected to the first section at the fixed pivot;

a third guide tube section pivotably connected to the second section at the at least one translatable pivot; and a fourth guide tube section pivotably connected to the third section.

9. The rig of claim 1, wherein the support rod and the intermediate support when tensioned by the winchline lift the guide tube from an at least partially folded position on the rig and support the unfolded guide tube for use.

10. A rig for continuous rod, comprising:

a mast;

a guide tube for guiding continuous rod from a reel to the rig, the guide tube having a plurality of guide tube sections pivotably connected together by at least one translatable pivot and mounted on the mast at a fixed pivot;

a support rod for lifting and unfolding the guide tube sections, the support rod disposed on one of the guide tube sections between the translatable pivot and the fixed pivot;

a winchline extendable from the mast to the support rod; and an intermediate support having a fixed length and extendable from the support rod to the at least one translatable pivot.

11. The rig of claim 10, wherein the intermediate support comprises a collapsible connection between the support rod and the at least one translatable pivot.

12. The rig of claim 11, wherein the intermediate support comprises a fixed length piece of the winchline attaching between the support rod and the at least one translatable pivot.

13. The rig of claim 11, wherein the collapsible connection comprises a sling separate from the winchline, the sling having one end attaching to the support rod and having another end attaching to the at least one translatable pivot.

14. The rig of claim 10, wherein the intermediate support comprises a support bar connectable between the support rod and the at least one translatable pivot.

15. The rig of claim 10, wherein the support rod pivotably connects to the one guide tube section.

16. The rig of claim 10, wherein the at least one translatable pivot comprises a linkage having first and second links pivotably connected together at a pivot point to which the intermediate support connects, the first link pivotably connected to one of the adjacent guide tube sections, the second link pivotably connected to the other adjacent guide tube section.

17. The rig of claim 10, wherein the guide tube sections comprise:

a first guide tube section mounted on the rig and having the fixed pivot;

a second guide tube section pivotably connected to the first section at the fixed pivot;

a third guide tube section pivotably connected to the second section at the at least one translatable pivot; and a fourth guide tube section pivotably connected to the third section.

18. The rig of claim 10, wherein the winchline, the support rod, and the intermediate support when tensioned lift the guide tube from an at least partially folded position on the mast and support the unfolded guide tube for use.

19. A continuous rod guide tube set up method, comprising:

providing a guide tube for guiding continuous rod from a reel to a rig, the guide tube having a plurality of guide tube sections pivotably connected together by at least one translatable pivot and mounted on the rig at a fixed pivot;

lowering at least some of the guide tube sections to the ground;

attaching a winchline from the rig to an attachment point on a support rod for lifting and unfolding the guide tube sections, the support rod disposed on one of the guide tube sections between the at least one translatable pivot and the fixed pivot;

moving the attachment point of the winchline to the support rod beyond the fixed pivot;

extending an intermediate support having a fixed length between the at least one translatable pivot and the support rod; and raising the guide tube about the fixed pivot with the winchline.

20. The method of claim 19, wherein the intermediate support comprises a collapsible connection between the support rod and the at least one translatable pivot.

21. The method of claim 20, wherein the intermediate support comprises a fixed length piece of the winchline attaching between the support rod and the at least one translatable pivot.

22. The method of claim 20, wherein the collapsible connection comprises a sling separate from the winchline, the sling having one end attaching to the support rod and having another end attaching to the at least one translatable pivot.

23. The method of claim 19, wherein the intermediate support comprises a support bar connectable between the support rod and the at least one translatable pivot.

24. The method of claim 19, wherein the support rod pivotably connects to the one guide tube section.

25. The method of claim 24, wherein moving the attachment point of the winchline to the support rod beyond the fixed pivot comprises pivoting the support rod away from the rig.

26. The method of claim 25, wherein pivoting the support rod comprises manually pulling the support rod with a rope attached to the support rod.

27. The method of claim 25, wherein pivoting the support rod comprises biasing the support rod to pivot away from the rig.

28. The method of claim 19, wherein lowering at least some of the guide tube sections to the ground comprises using the winchline connected between the rig and a pivot between the guide tube sections.

* * * * *